United States Patent [19]

Hazen

[11] Patent Number: 4,505,326

[45] Date of Patent: Mar. 19, 1985

[54] HEAT PIPES WITH SHROUDED FINS AND FAN

[75] Inventor: Craig B. Hazen, Irvine, Calif.

[73] Assignee: Northwest Alaskan Pipeline Company, Salt Lake City, Utah

[21] Appl. No.: 494,416

[22] Filed: May 13, 1983

[51] Int. Cl.[3] ..... F25D 1/00; F28D 15/00; F28F 13/12

[52] U.S. Cl. ..... 165/45; 165/122; 62/260

[58] Field of Search ..... 165/45, 122; 62/260

[56] References Cited

U.S. PATENT DOCUMENTS 3,935,900 2/1976 Waters ..... 165/45
4,194,856 3/1980 Jahns ..... 165/45

FOREIGN PATENT DOCUMENTS 460538 5/1928 Fed. Rep. of Germany ..... 165/122
475226 2/1915 France ..... 165/45

*Primary Examiner*—Albert W. Davis, Jr.
*Attorney, Agent, or Firm*—Mason, Fenwick & Lawrence

[57] ABSTRACT

A soil freezing apparatus includes a vertically oriented sealed heat pipe containing refrigerant and having a soil-embedded lower end and an upper end with radial heat exchange fins for conducting heat from the pipe to the atmosphere. A cylindrical tubular open-ended shroud means is fitted over the heat exchange fins for enclosing same and an electric motor driven fan is operable for effecting the upward flow of ambient air through the shroud means in contact with the heat exchange fins for increasing the heat flow rate from the fins to the atmosphere.

10 Claims, 3 Drawing Figures

HEAT PIPES WITH SHROUDED FINS AND FAN

BACKGROUND OF THE INVENTION

The present invention is in the field of an earth freezing apparatus and is more particularly directed to a unique heat pipe assembly and sub-components thereof for enhancing the freezing and maintenance of frozen soil for providing stabilized support of structures supported on or embedded in the soil.

It is has long been recognized that metal pipes having proper refrigerant on their interior can be embedded in the soil in areas having colder climates with their upper ends exposed to the atmosphere so that heat flows from the soil into the refrigerant which, when the air temperature is sufficiently low, is chilled by the cooler atmosphere and flows to the bottom of the pipe where it absorbs heat from the soil to complete the cycle. The heat absorbed from the soil results in maintaining the surrounding soil in frozen condition or promoting the growth of frozen soil. Pipes of the foregoing type are referred to as "heat pipes" and are disclosed in U.S. Pat. Nos. 3,217,791; 3,840,068; 3,935,900 and 4,090,555. The devices disclosed in patents of the aforementioned type comprise heat pipes having longitudinally extending generally radial fins at the upper exposed ends of the pipe for enhancing the flow of heat from the vapor on the interior of the pipe outwardly to the surrounding ambient atmosphere. The rate in which the heat flow occurs varies in accordance with a number of parameters including the temperature differential between the inside of the pipe and the ambient atmosphere of the refrigerant or working fluid used in the heat pipes and the wind velocity over the surface of the exposed pipe and associated fin arrangement. While increased wind velocity results in increased heat flow, the influence of the wind on the exposed pipe and fin arrangement fluctuates so much due to the climatological, geographic and weather variations as to render the forecasting of the amount of heat extraction for a particular installation extremely difficult. Consequently, heat pipes are frequently designed with a far greater capacity than is actually necessary in order to provide adequate heat extraction capacity for low wind velocity conditions. It has consequently been impossible to obtain optimum cost effectiveness in the design of heat pipe installations.

SUMMARY OF THE INVENTION

Therefore, it is a primary object of the present invention to provide a new and improved heat pipe assembly.

A further object of the present invention is a provision of a new and improved heat pipe assembly which can be optimally sized for particular installations and which can be used to enhance the heat-extraction performance of existing heat pipe installations.

Achievement of the foregoing objects is enabled by the preferred embodiment of the invention which employs a conventional heat pipe having radially extending heat exchange fins extending along its length adjacent its upper end. A tubular cylindrical shroud is fitted over the finned portion of the pipe for providing uniform air flow thereon. The tubular cylindrical shroud covers approximately the upper 75% to 100% of the fins and is provided with an internally positioned fan in its upper end driven by an electric motor which when operated acts to draw the ambient air upwardly along the surface of essentially the entire length of the heat exchange fins for discharge out the top of the cylindrical shroud member. Thus, it is consequently possible to obtain a predictable heat flow capacity for the system dependent upon the temperature differential between the ambient air and the refrigerant vapors on the interior of the heat pipe. Moreover, the arrangement is such that the chilled refrigerant liquid which runs down the interior of the wall of the pipe and the upwardly flowing ambient air on the interior of the shroud are in counter-flow heat exchange mode of operation which provides additional functional heat extraction efficiency far in excess of the efficiency that would be obtained in the absence of the electric fan and shroud arrangement. The net result of the foregoing arrangement is that the liquid returned to the bottom of the heat pipe is colder and the cycle time is less than would be the case without the use of the shroud and motor arrangement, and thereby heat extraction capability of a heat pipe is enhanced.

A better understanding of the preferred embodiment will be achieved when the following detailed description is considered in conjunction with the appended drawings in which like reference numerals are used for the same parts as illustrated in the different figures.

DESCRIPTION OF THE PREFERRED EMBODIMENT

Figure 1:
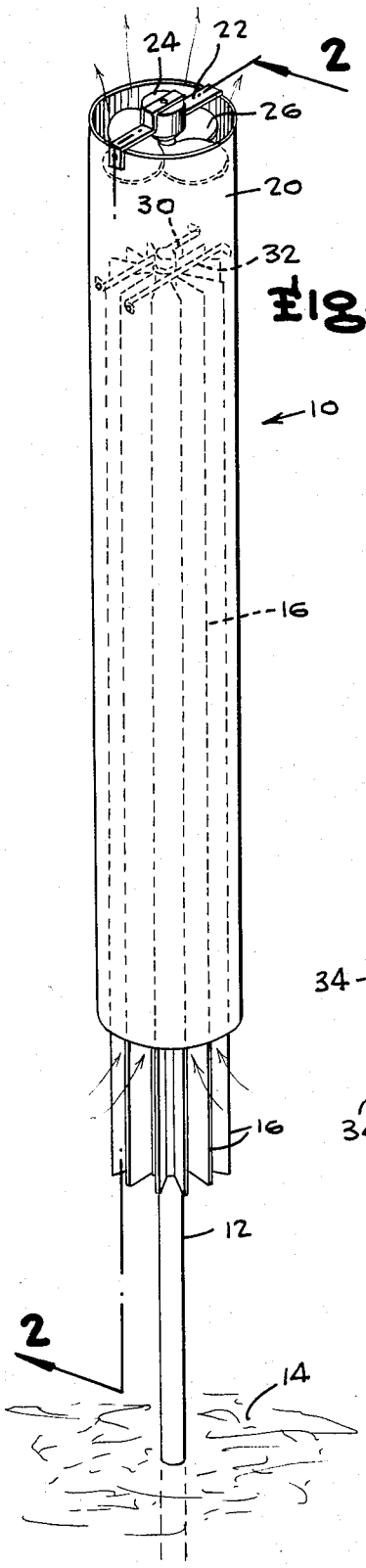
FIG. 1 is a perspective view of the preferred embodiment of the invention.

The preferred embodiment of the invention, which is generally designated 10, comprises a heat pipe assembly consisting of a pipe member 12 containing refrigerant which is embedded in the earth 14 and which has a plurality of radially oriented fins 16 mounted on a fin support sleeve 18 fitted over the upper end of the pipe. The aforementioned structural elements are conventional and can be of the type illustrated in the previously noted patents such as U.S. Pat. No. 4,090,555 or others. Devices of this type function by the absorption of heat from the fins by the surrounding atmosphere so as to cool and condense refrigerant vapors or cool fluids on the interior of the uppermost portions of the pipe 12. The present invention enhances the heat flow from the fins to the ambient atmosphere by permitting a constant flow of air along the surfaces of the fin members so as to maintain a high heat flow capacity at all times independently of the ambient wind velocity when the system is being operated.

Figure 2:
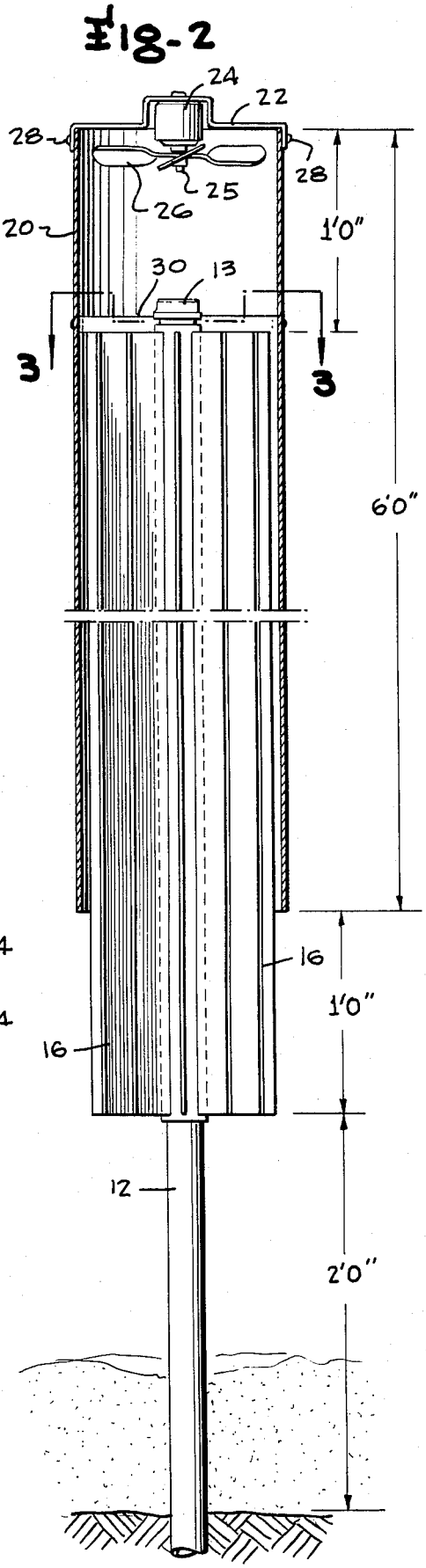
FIG. 2 is a sectional view taken along lines 2—2 of FIG. 1.
Figure 3:
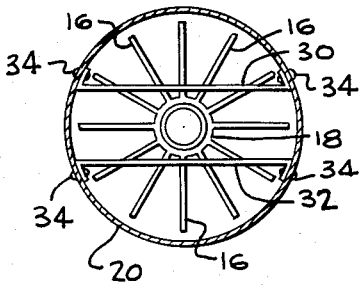
FIG. 3 is a sectional view taken along lines 3—3 of FIG. 2.

Achievement of the ability to provide a constant air flow across the surface of the fins 16 is enabled by the provision of an open-ended shroud 20 of tubular cylindrical configuration having an internal diameter slightly greater than the maximum diameter of fins 16 so as to be matingly fittable over the fins in the manner best illustrated in FIGS. 2 and 3. A fan motor support bracket 22 extends diametrically across the upper end of the tubular cylindrical shroud 20 and provides support for an electric motor 24 on the shaft 25 of which a fan 26 is mounted. Fan motor support bracket 22 is fixedly connected to the shroud by metal screw means 28 or other equivalent connector means.

Stop members are provided on the interior of the tubular cylindrical shroud member 20 for engagement with the upper ends of fins 16 for providing support for the tubular cylindrical shroud 20 and the associated motor and fan assembly 24, 26, etc. The stop members comprise a pair of chordal angle members 30 and 32 (FIG. 3) which are parallel to each other and spaced apart a sufficient distance to be on opposite sides of the end cap 13 provided on the upper end of pipe member 12. Chordal angle members or brackets 30 and 32 are connected to the shroud member 20 by metal screws 34 or other equivalent connector members.

Thus, the preferred embodiment permits the fan 26 to maintain a continuous air flow along the line of the fin members 16 so as to provide for optimum heat exchange capability. Moreover, the counter-flow arrangement of the liquid condensate or fluid on the interior of the pipe 12 which moves downwardly while the air flow is moving upwardly provides further enhancement of the heat flow from the condensate to the air. It will be seen from inspection of FIG. 3 that the arrangement provided by the use of the shroud is much more efficient than would be the case with bare fins even during windy conditions since the fins on the downstream side of the pipe would receive scant benefit from the wind flow due to the shielding effect of the other fins.

Numerous modifications of the preferred embodiment will undoubtedly occur to those of skill in the art without departing from the spirited scope of the invention as set forth in the following claims. For example, in some instances it might be desirable to provide a cover spaced upwardly above the fan motor support bracket 22 for protecting the assembly from snow or rain. Additionally, while the motor 24 would normally be provided power from power lines extending from a power source, it would be possible for the power source in some instances to be solar cells, batteries or possibly combinations of both. Thus, in any event, it is reemphasized that the spirit and scope of the invention is to be limited solely by the appended claims.

I claim:

1. In a soil freezing apparatus including a generally vertically oriented heat pipe having a lower end capable of being embedded in the earth and an upper end provided with heat exchange fins for conducting heat from the pipe to the atmosphere, the improvement comprising open-ended shroud means comprising a tubular cylindrical pipe concentrically positioned over the upper end of said heat pipe and fittable over said heat exchange fins for enclosing same and wherein said shroud means is removably supported on said fins and can be axially lifted from said heat pipe fins and said heat pipe, stop means positioned internally of said shroud for engagement with said fins for limiting downward movement of said shroud relative to said fins and electric motor driven fan means operable for effecting the flow of ambient air through the shroud means in contact with the heat exchange fins for increasing the heat flow rate from the fins to the atmosphere.

2. The soil freezing apparatus of claim 1 wherein said stop means comprises chordal bracket means extending across the interior of said shroud means.

3. In a soil freezing apparatus including a generally vertically oriented heat pipe having a lower end capable of being embedded in the earth an an upper end provided with heat exchange fins for conducting heat from the pipe to the atmosphere, the improvement comprising open-ended shroud means comprising a tubular cylindrical metal member having an internal diameter slightly exceeding the maximum diameter of said fin means for enclosing same so as to be removably positionable over and supported by said fin means, stop means positioned internally of said shroud for engagement with said fins for limiting downward movement of said shroud relative to said fins, and electric motor driven fan means positioned adjacent to the upper end of said shroud means and operable for moving air upwardly through said shroud means operable for effecting the flow of ambient air through the shroud means in contact with the heat exchange fins for increasing the heat flow rate from the fins to the atmosphere.

4. The soil freezing apparatus of claim 3 wherein said stop means comprises chordal bracket means extending across the interior of said shroud means.

5. The soil freezing apparatus of claim 3 wherein said electric motor driven fan means is positioned internally of said shroud means.

6. The soil freezing apparatus of claim 5 wherein said stop means comprises chordal bracket means extending across the interior of said shroud means.

7. In a soil freezing apparatus including a generally vertically oriented heat pipe having a lower end capable of being embedded in the earth and an upper end provided with heat exchange fins for conducting heat from the pipe to the atmosphere, the improvement comprising open-ended shroud means comprising a tubular cylindrical pipe concentrically positioned over the upper end of said heat pipe and fittable over said heat exchange fins with the lower end of said fins not being covered by said shroud means, electric motor driven fan means positioned internally of the upper end of said shroud means operable for effecting the flow of ambient air through the shroud means in contact with the heat exchange fins for increasing the heat flow rate from the fins to the atmosphere and stop means positioned internally of said shroud means for engagement with said fins for limiting downward movement of said shroud relative to said fins and wherein said shroud means is removably supported on said fins and can be axially lifted from said fins and said heat pipe.

8. The soil freezing apparatus of claim 7 wherein said stop means comprises chordal bracket means extending across the interior of said shroud means.

9. The soil freezing apparatus of claim 8 wherein said fins extend lengthwise of the heat pipe in planes radial to the axis of the heat pipe.

10. The soil freezing apparatus of claim 9 wherein said chordal bracket means comprise spaced parallel angle members extending across the interior of said shroud means.

* * * * *